US005174720A

United States Patent [19]

Gradl

[11] Patent Number: 5,174,720

[45] Date of Patent: Dec. 29, 1992

[54] ARRANGEMENT FOR ATTACHING BLADES ON THE WHEEL OF A ROTOR

[76] Inventor: Ottomar Gradl, Höglwörtherstr. 266, 8000 München 70, Fed. Rep. of Germany

[21] Appl. No.: 807,159

[22] Filed: Dec. 13, 1991

[30] Foreign Application Priority Data

Dec. 14, 1990 [DE] Fed. Rep. of Germany ..... 4040068
Sep. 27, 1991 [DE] Fed. Rep. of Germany ..... 4132332

[51] Int. Cl.[5] ..... B63H 1/20

[52] U.S. Cl. ..... 416/204 A; 416/219 R; 416/222; 416/248; 416/216

[58] Field of Search ..... 416/204 A, 215, 216, 416/219 R, 220, 222, 248

[56] References Cited

U.S. PATENT DOCUMENTS 2,619,318 11/1952 Schaer ..... 416/200 A
2,857,132 10/1958 McDowall ..... 416/222

FOREIGN PATENT DOCUMENTS 0975003 2/1951 France ..... 416/216

*Primary Examiner*—Thomas E. Denion
*Attorney, Agent, or Firm*—Pearne, Gordon, McCoy & Granger

[57] ABSTRACT

To attach blades (5) on a rotor wheel for turbines or compressors, the wheel (1) has threads (2) running to the inside in a spiral shape on both sides of the outer edge. The blades (5) have segments on their feet (7) of counter-threads shaped accordingly. The threads are designed to have one turn, and their beginnings are staggered 180° to one another on both sides of the wheel to offset inbalances. The threads on the wheel and on the blade feet there are self-locking and prestressed.

26 Claims, 6 Drawing Sheets

ARRANGEMENT FOR ATTACHING BLADES ON THE WHEEL OF A ROTOR

BACKGROUND OF THE INVENTION

The invention concerns an arrangement for attaching blades to the wheel of a rotor.

A blade attachment for axial-flow gyrowheel machines is known from German utility model 1739025, in which the blades are kept interlocked by spiral-shaped grooves around the circumference of the wheel and on the feet of the blades. The foot of each blade has a threaded section, and there is a threaded section on the foot of the adjacent blade with a continuous thread that matches the thread on the circumference of the wheel. The pitch of the spirals is chosen so that the connection is self-locking.

The known connection is sufficient for rotors subject to low stresses. For highly stressed rotors of turbines or compressors with peripheral speeds up to 500 m/sec, however, tractive forces up to 2 tonnes can occur in the blade, in addition to thermal stresses. On the other hand, at wheel diameters of approximately 15 cm, the only surfaces available for transmitting the forces are small, i.e., when the known groove connection is used, at least three thread turns must mesh, which is hard to achieve with a thread with only one turn. But threads with many turns, because of their higher pitch, reach their self-locking limit faster.

Moreover, the known connection does not take into consideration the fact that because of the asymmetry of the spiral thread, a rotor without blades can be unbalanced. At the high stresses specified, imbalances must be avoided at all costs.

The task of the invention is to design an attachment arrangement of the type specified at the beginning to make sure that the blades will not come loose during operation, and that there is no inherent design imbalance.

To solve the task, the present invention provides: that the thread on the wheel is designed to have one turn; that the start of the thread on one side of the wheel is slightly staggered, compared to the start of the thread on the other side, and runs in the opposite direction around the circumference; and that the threaded prestressed section of the blade foot meshes with the threads on the wheel. The eccentricity of one spiral thread is thus offset by the opposite thread. The initial stress between the blade feet and the wheel also guarantees that the blades fit securely during all stresses that may occur.

Both threads on the wheel can be designed as outer threads on the outer edge on both opposite sides. In this way, the mass is kept small, and the wheel can be produced with no cutting, for example, by roll forming, which substantially increases the permitted stress. The corresponding inner threads are provided on the blade feet in a slot which extends radially from the inside to the outside in the web forming the foot.

Since the foot of each blade has only a short section of the total thread, both opposing threads are relatively simple to produce.

However, it is likewise possible to give the outer edge of the wheel a groove that runs in the direction of the circumference and extends radially to the inside, and which has an inner thread on each of the opposite inner flanks, while the outer threads have webs forming the blade foot on both sides.

The screwed-in blades, under the initial stress, are preferably fixed by means of stop faces, which can be designed on the lower edge of the blade foot or on flanges on the transition to the blade profile. The initial stress is preferably produced thermally, by cooling the blades and turning them when cold with a minimal expenditure of force, with almost no friction in the direction of the circumference on the wheel until the first and last blade stand next to one another with no play. Subsequent reheating to room temperature then produces the desired initial stress. Alternatively, or even additionally, the wheel can be heated before the blades are put on.

When the blades are connected to a cover band, or so-called "clappers", the blade attachment in the invention also makes it possible for them to be attached to the cover band or clapper, wherein the individual cover band or clapper elements lie close to one another with their edges touching for this purpose. Thus, initial stress can also be produced in the cover band, which counteracts the stresses that occur during operation. For example, the blades can also be screwed in without stress by cooling the cover band on the ends of the blades, so that when the ends of the blades are warmed to room temperature, a compressive strain is produced in the cover band. The result of this is a tractive force in the blade and a tangential tractive force in the wheel. One advantageous consequence is that a smaller sealing gap is provided so that, for example, the efficiency of the individual rotating blades of a drive gear can be increased considerably.

In order that the wheel is able to take higher tangential stresses, it can have a winding of fibrous materials, which are ideally stressed in their tractive direction, along its circumference. This winding can be in a rotating slot, which is locked by the foot of the blade. This has the simultaneous advantage of protecting the winding from outside influences. The slot is advantageously locked with an adapter, which at the same time prevents the slot flange from bending during stress. This adapter is conveniently formed by one part of the foot of the blade.

The fibers used can be, for example, fiberglass, carbon fibers, silicon carbide fibers or metallic fibers, or combinations thereof. It is essential that the fibers have a high tensile strength and a low density. For the same stress, the wheel can be built substantially lighter. To achieve initial stress in the winding, the wheel body can be cooled before and during the attachment of the winding. After an almost tension-free attachment of the winding, and subsequent heating of the wheel to room temperature, there is a tangential tractive initial stress in the winding, and a tangential compressive strain in the remaining wheel body. The winding can be applied without an embedded matrix, so that the material properties can be used to the utmost, especially at high fiber temperatures.

By choosing a suitable fiber, the life of a wheel can be lengthened considerably. The wheel filled with the fiber materials can be stopped at an initial compressive strain, while during operation the compressive strain is gradually decreased and transferred to a tractive force, i.e., the tension amplitude remains, but the median value of the stress falls to a lower level.

When using a winding from fibers subject to a tractive force, the slot enclosing the winding may have flanges pointing inward in the cross section on the outer periphery of the wheel, which overlap the blade foot from the outside. The blade foot can then be designed as a so-called "hammer foot", wherein one thread can be eliminated, if necessary.

Another improvement in the efficiency of the winding is possible if the winding is composed of different fibers. Thus, in the radial inner area of the winding, fibers with a large modulus of elasticity (e.g., soft fibers) can be used, making it possible for a force to be introduced in the hard fibers lying on top.

The blades are further secured in the wheel when the thread flanks are inclined at an angle outward on the blade feet in the radial direction. The blades will then be pressed on the wheel to interlock non-positively by the effect of centrifugal force.

Furthermore, the spacers can be arranged between the blade feet so that the distance between individual blades is increased somewhat, producing at the same time an increase in the radius, so that the sealing gap in the area of the cover band can be reduced or set. In this way, during repairs or when the cover band wears out, the sealing gap can be reset exactly. The spacers need not be used between all of the blade feet, but can be adjusted in number according to the respective requirements. It is important only that they are distributed evenly over the periphery of the wheel so that there is no imbalance. They can be designed as self-supporting clamping rings, which are curved upward and inserted between two blade feet.

BRIEF DESCRIPTION OF THE DRAWINGS

The invention will be described in greater detail below using the drawings. The drawings are schematic representations that show.

DETAILED DESCRIPTION OF THE PREFERRED EMBODIMENTS

Figure 1:
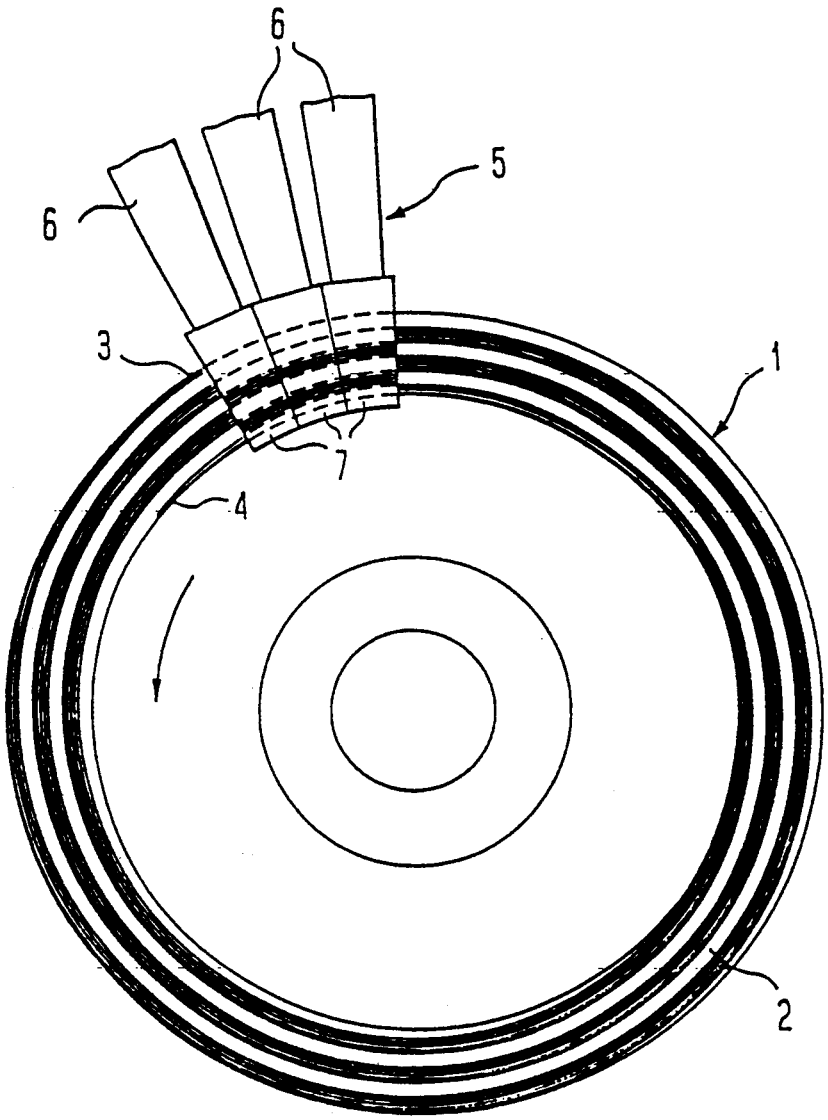
FIG. 1 a rotor wheel with blades attached to it.

FIG. 1 shows the wheel 1 of a rotor. The wheel has a single-turn thread 2 on its outer edge, which runs like a spiral from the outside to the inside. The thread begins at the point marked 3 at the outer edge of the wheel and ends at 4. On the opposite side of the wheel, there is a similar thread, but its beginning and end are staggered somewhat, and it runs in the opposite direction.

In the area near its outer edge, the wheel 1 has blades 5, three of which are pictured in FIG. 1. The blades consist of the blade profile 6 and the blade foot 7. The blade foot 7 has a counter thread to the thread 2 with which each blade is attached to the edge of the wheel. Each blade also has a threaded section or segment, wherein the feet of all blades are not designed identically; instead, the threaded section of each blade with its pitch is connected to the thread section of both adjacent blades. When the rotor wheel is completely assembled, the threaded sections of all the blades in a row are complementary to one whole thread, which corresponds to the thread made on the wheel.

Figure 2:
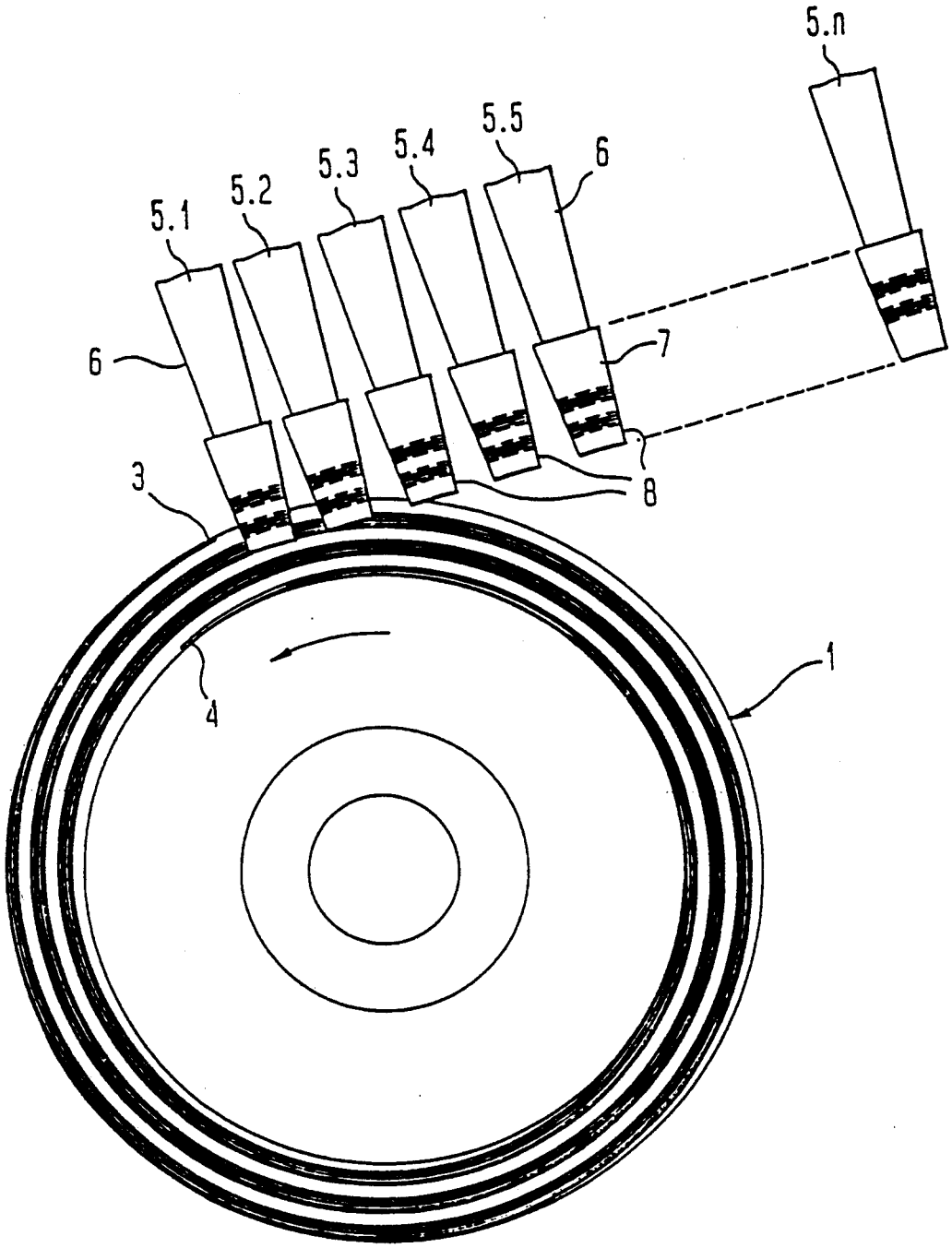
FIGS. 2 and 3 the blades attached one after the other to the wheel.
Figure 3:
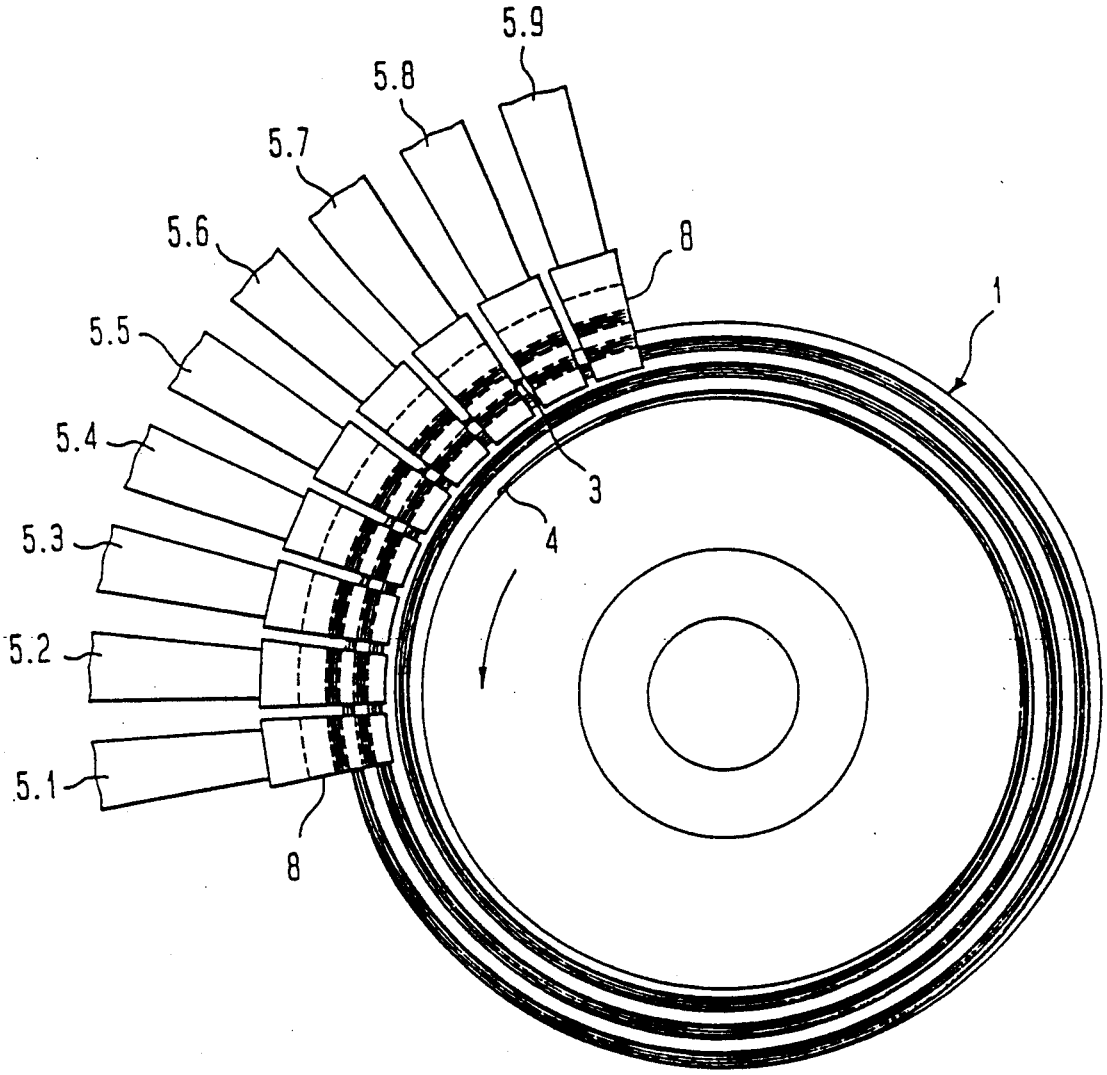

FIGS. 2 and 3 show the process of placing the blades on the wheel 1. The first blade 5.1 is inserted into it where the thread starts 3. The other blades (5.2, 5.3, etc.) follow. In FIG. 3, the blades are inserted into the first turn along roughly one-fourth of the circumference of the wheel. The front surfaces 8 of the webs forming the blade feet do not run parallel, but rather to the inside, one after the other, depending on their radial orientation. When all the blades are inserted, the last blade **5.*n* is connected to the first blade 5.1, and the outer turn is completely full. Between the blades and the front of the blade feet, however, there are spaces. When further rotated, the blades move closer and closer together, until they are very close together in the end position, shown in FIG. 1**, and coincide with the turns exactly.

An initial stress is produced between the blade feet and the rotor wheel by cooling the blades before use, for example, by dipping them in liquid nitrogen and putting them on the wheel in their cold state. When they are warmed to room temperature, an initial stress is formed, which also remains under operating conditions. The initial stress allows the given ratios to be adjusted by adjusting the temperature, which can also include warming the wheel, if necessary.

There are various possibilities for designing the thread on the wheel and on the blade feet, four of which are shown in FIGS. 4 to 7. According to FIG. 4, two revolving flanges are designed on the edge of the wheel, on the outer side of which there is an outer thread. The corresponding counter threads are in a longitudinal groove on the inside of the blade foot. To keep the flange from moving to the inside during operation, a spacer can be placed between them.

Figure 5:
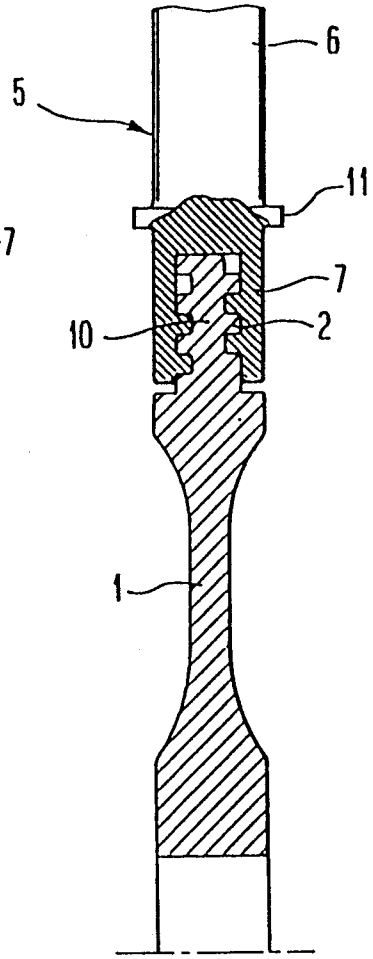
Figure 4:
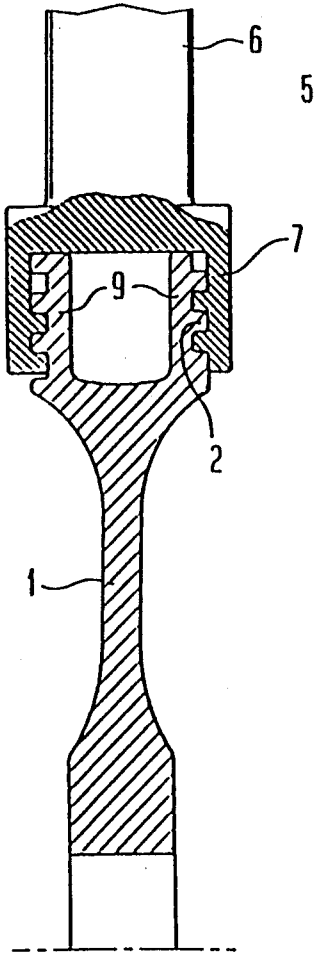

In FIG. 5, the outer thread is also on the wheel and the inner thread on the blade foot, but the wheel has only one flange 10, which has an outer thread on both of its outer surfaces. This type of wheel edge is easier to produce, while the design in FIG. 4 is better for taking the pull-out torque exerted in the axial direction. Another variation, as in FIG. 6, involves putting an inner thread on both flanges 9 of the edge of the wheel, wherein the outer thread is designed on the blade foot 7.

Figure 6:
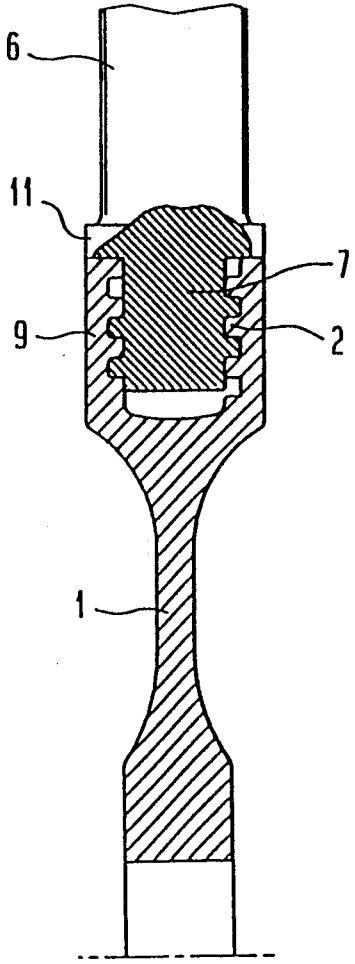
FIGS. 4 to 8 various embodiments of the thread and the fiber winding in cross section.

The threads that are just shown schematically in FIGS. 4 to 6 as square threads can be formed and contoured to correspond to the stresses that occur. One especially favorable form is the thread in FIG. 7, where the thread flanks on the blade feet are inclined outward at an angle in the radial direction and go into counter threads designed accordingly on the flanges 9 of the wheel. This makes it impossible for the thread to loosen or unhook because of the effects of centrifugal force.

The blades are attached in the screwed-in end position by clamping forces, wherein the limit to which they can be screwed in can be set by stop surfaces either on the inner edge of the blade foot or on the flange 11 between the blade foot 7 and the blade profile 6. The thread is designed to be self-locking, and it runs in the rotational direction of the rotor from outside to inside, as shown in FIGS. 1 and 2, so that the blades are introduced in the screw-in direction during the starting process by tangential forces.

As can be seen, the wheel is not weakened on its outer periphery by any kind of holes, recesses or the like, so that it can take not only radial stresses, but also axial and tangential stresses with no problem. This saves materials compared to conventional attachments and thus reduces the mass of the wheel.

With rotor blades, it is known how to provide a cover band on the extreme outer periphery of the blades, in order to prevent oscillation or twisting of the blades or to achieve a seal between the housing and the rotating blades. The cover band consists of individual cover band elements in the form of small metal plates, each of which is attached to the outer end of the blade. The front and rear edges of the cover band elements in the direction of movement have an increasing configuration, so that they are complementary to a peripheral band and cannot twist against one another. In conventional blade attachments, there are slight distances between the adjacent edges of the cover band elements. When the blade ends twist slightly on the longitudinal blade axis, the corresponding edges of the cover band elements come into contact with one another and thereby prevent further twisting.

Figure 9:
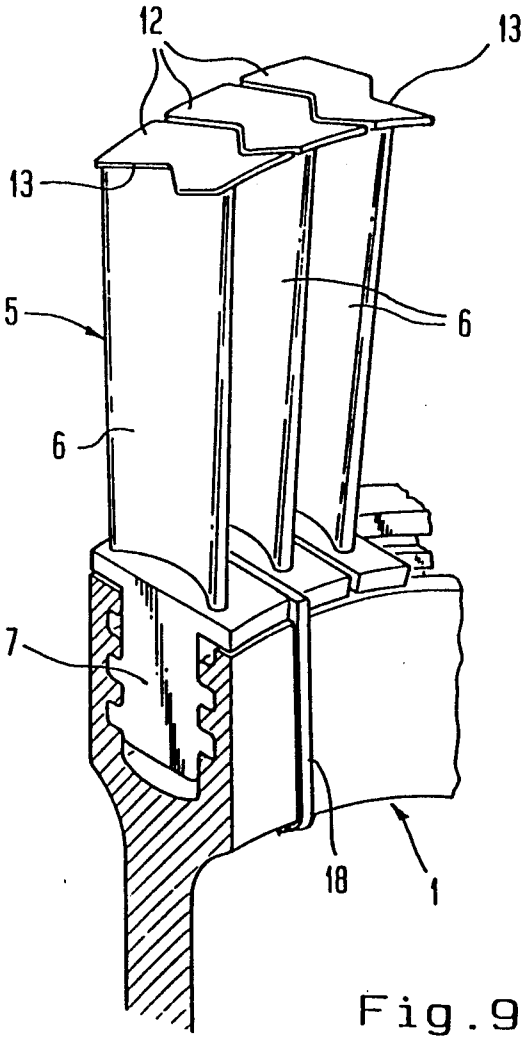
FIG. 9 three blades attached to the periphery of the wheel with cover band elements and spacers.

The blade attachment in the invention makes it possible to place the cover band elements next to one another, interlocking and actuated by friction when standing still, and to produce an initial stress working against the stresses that occur. FIG. 9 shows a perspective view of a cutout from the area of the edge of the wheel 1 with the blades 5 inserted in it. Each blade has a cover band element 12. In this embodiment, the limit of the insertion process is no longer determined by stop surfaces in the area of the blade foot, but rather by the joint placement of the cover band elements with their front and back edges 13 formed accordingly in the direction of movement. When inserted, the blade ends are cooled in the area of the cover band elements, so that they shrink and result in an overall shortened cover band element. If the blades are now screwed in so far that the cover band elements stand next to one another, during the subsequent rewarming tension is formed, tangentially in the cover band, and either logitudinally or radially in the blades. This tension is counteracted by the stresses of centrifugal force that occur during operation, which thus helps reduce the radial expansion of the blades. By suitably measuring the initial stress, one may distribute the stress optimally in the composite of the wheel, the blades and the cover band.

Naturally, instead of cooling the blades, or as a supplement to it, the wheel (and, if need be, the blade feet) can also be heated.

Figure 8:
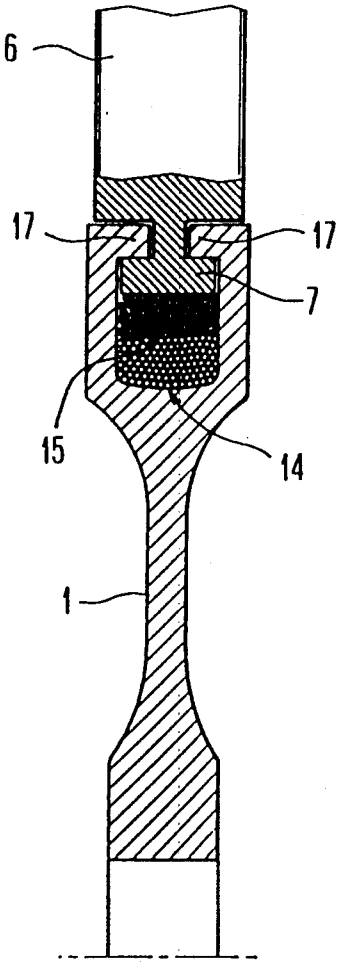
Figure 7:
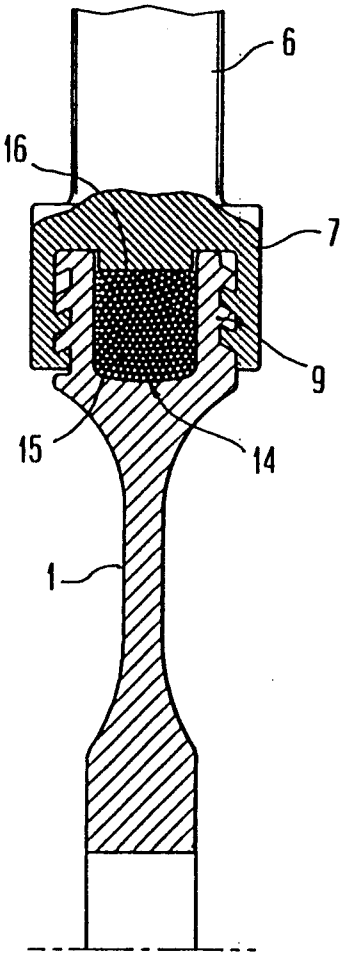

It can be seen, in FIGS. 7 and 8, in a cross-section of the arrangement, that the groove 14 arranged on the outer edge of the blade is filled with a winding 15 of fibers, which ideally are stressed in the tangential direction. In FIG. 7, the groove is locked with an adapter 16 formed by the blade foot, so that the fibers are protected. This adapter is also used to support the outer wheel flange from the stress in operation. It can also be used to support individual elements, which has the advantage that the wheel can be prestressed when it is produced, so the flanges cannot warp to the inside.

In FIG. 8, the groove 14 has flanges 17 pointing to the inside on the outer edges, overlapping the blade foot 7, which is designed like a hammer head, so that it interlocks and is secured from loosening in the radial direction. The winding 15 put into the groove 14 with initial tension consists of two layers of fibers with different material properties. The fibers of the inner layer have a higher modulus of elasticity and different heat expansion coefficients than the fibers on the outer layer. Thus, the introduction of forces in the fiber material, which is sensitive to the shearing forces, is especially favorable.

FIG. 9 shows a spacer placed between two adjacent blade feet. Such spacers allow the distance between the blades to be set, if necessary even after the fact. Since the circumference of the circle formed by the blade feet is increased by the insertion of a spacer, the radius also increases accordingly. The sealing gap between the blades and the cover band and the housing can be set precisely in this way.

The spacers 18 are designed as clamping rings, for example, which are inserted curved upward between two blade feet. They must be distributed in number and arrangement over the periphery of the wheel, so that no imbalance can occur.

Figure 10:
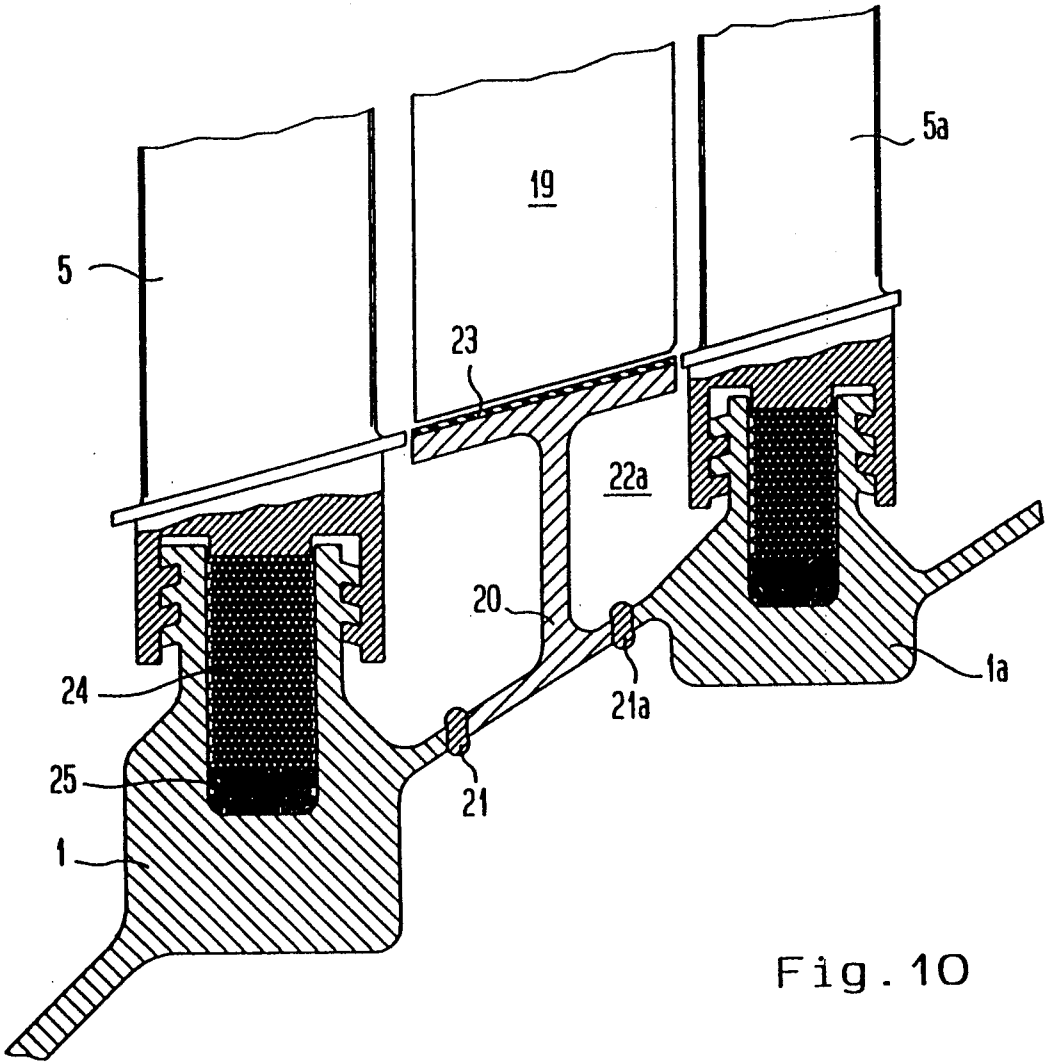
FIG. 10 a schematic sectional view through a rotor connection.

The blade attachment in the invention can also be used advantageously in reciprocal positioning of several rotors in multilevel turbines or compressors. FIG. 10 shows schematically two rotor wheels, 1 and 1*a*, with rotor blades, 5 and 5*a*, between which there is a fixed blade 19. The spacer 20 between the rotor blades is welded at 21 and 21*a* to the rotor blades 1 and 1*a*, so that pressure-sealed chambers, 22 and 22*a*, are formed between them and the shaft. This makes it unnecessary to put sealing lips on the base of the blade, which are difficult to build in because of the small fit. In the arrangement in FIG. 10, on the other hand, a seal 23 is only necessary between the spacer 20 and the fixed blades 19, which can be achieved easily during construction.

FIG. 10 also shows two layers, 24 and 25, of different fibers in the peripheral groove of both rotor wheels, 1 and 1*a*.

I claim:

1. An arrangement for attaching blades to a rotor wheel having opposite sides and an outer edge, comprising two threads, one thread on each opposite side of the wheel and running inward in a spiral shape from a beginning on an outer edge of said wheel, said beginning on one side of said wheel being circumferentially staggered in relation to the beginning of the other thread by 180°, in the circumferential direction, said threads having one turn, each blade including a foot having threaded segments, said threaded segments corresponding to and fitting together with said threads on said wheel.

2. An arrangement according to claim 1, wherein said threads on said wheel are designed as outer threads on each side of said wheel, each blade foot having a groove running in the direction of rotation of said wheel, said groove having inner flanks, said inner flanks having inner threads corresponding to said outer threads.

3. An arrangement according to claim 2, having on the outer edge of said wheel two flanges separated by a groove, said outer threads being on the outside of said flanges.

4. An arrangement according to claim 1, wherein said wheel has on its outer edge a circumferential groove, said groove extending inward radially and having inner flanks, having on said inner flanks inner threads running radially to the inside, and each blade foot being formed as a circumferentially running web, said foot having outer threads corresponding to said inner threads.

5. An arrangement according to claim 1, wherein said thread running from the outside to the inside runs in the direction in which said wheel rotates.

6. An arrangement according to claim 1, wherein said blade feet have inner longitudinal edges to hold said blades in a screwed-in position.

7. An arrangement according to claim 6, wherein a flange is provided at a transition from said blade foot to a blade profile, said flange forming a stop to hold each blade in the screwed-in position.

8. An arrangement according to claim 1, an initial stress between said thread segments of said blade feet and said threads on said wheel having been produced by the changing of temperature of at least one of said blades and said wheel during attachment of said blades to said wheel.

9. An arrangement according to claim 8 wherein said initial stress was produced by cooling said blade feet.

10. An arrangement according to either of claims 8 or 9, wherein said initial stress was produced by heating said wheel.

11. An arrangement according to claim 1, wherein a cover band is formed from a plurality of cover band elements on an outer periphery of said blades, said cover band elements are adjacent with no play between their front and rear edges in the longitudinal direction.

12. An arrangement according to claim 11, wherein said cover band elements are adjacent and are under initial stress.

13. An arrangement according to claim 12, wherein said initial stress was produced by influencing the temperature of said blades near the time of the attachment of said blades to said wheel.

14. An arrangement according to claim 13 wherein said initial stress was produced by cooling said outer end of said blades.

15. An arrangement according to either of claims 13 or 14 wherein said initial stress was produced by heating said wheel.

16. An arrangement according to claim 1, wherein said wheel has a winding of fibers providing a tractive power for absorbing a tangential stress in said wheel and blades, said fibers selected from the group consisting of at least one of glass fibers, carbon fibers, and silicon carbide fibers.

17. An arrangement according to claim 16 wherein said winding is under initial stress on said wheel.

18. An arrangement according to claim 16 wherein said winding is in a groove running on said outer edge, said groove being defined by two flanges.

19. An arrangement according to claim 18 wherein said groove is locked by a corresponding adapter absorbing axial forces from said flange.

20. An arrangement according to claim 19, wherein said adapter is an integral part of said blade foot.

21. An arrangement according to claim 16, wherein said groove on said outer edge is defined by opposing flanges inwardly facing each other, said flanges overlapping said blade foot.

22. An arrangement according to claim 16 wherein said fiber winding comprises at least one fiber selected from the group consisting of glass fibers, carbon fibers and silicon carbide fibers.

23. An arrangement according to claim 16 wherein said fiber winding comprises at least two fibers selected from the group consisting of glass fibers, carbon fibers and silicon carbide fibers.

24. An arrangement according to claim 1, wherein said threads on said blade feet have flanks inclined at a radially outward angle.

25. An arrangement according to one of claims 1, 8, 11, 16, or 24 comprising spacers being placed between adjacent blade feet, said spacers being distributed evenly about said wheel.

26. An arrangement according to claim 25 comprising said spacers being clamps.

* * * * *